US010885859B2

(12) United States Patent
Mitsuzawa

(10) Patent No.: US 10,885,859 B2
(45) Date of Patent: Jan. 5, 2021

(54) DISPLAY DEVICE AND IMAGE DETERMINATION DEVICE

(71) Applicant: Japan Display Inc., Tokyo (JP)

(72) Inventor: Yutaka Mitsuzawa, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 16/393,533

(22) Filed: Apr. 24, 2019

(65) Prior Publication Data

US 2019/0333460 A1 Oct. 31, 2019

(30) Foreign Application Priority Data

Apr. 27, 2018 (JP) ..... 2018-087714

(51) Int. Cl.
*G09G 3/20* (2006.01)
*G09G 3/36* (2006.01)

(52) U.S. Cl.
CPC ... *G09G 3/3611* (2013.01); *G09G 2300/0857* (2013.01); *G09G 2310/08* (2013.01); *G09G 2320/103* (2013.01); *G09G 2330/021* (2013.01)

(58) Field of Classification Search
USPC ... 345/204, 55, 555, 77, 678, 690, 211, 213; 315/169.3
See application file for complete search history.

(56) References Cited

U.S. PATENT DOCUMENTS 6,211,854 B1 4/2001 Fujiyoshi
6,803,896 B2 10/2004 Senda et al.
7,499,010 B2 * 3/2009 Mizumaki ..... G09G 3/3611 345/204
8,154,478 B2 * 4/2012 Park ..... G09G 3/3208 315/169.3
8,922,574 B2 * 12/2014 Lim ..... G09G 3/3648 345/555
9,318,072 B2 * 4/2016 Cha ..... G09G 5/006 345/55
2007/0035484 A1 * 2/2007 Chang ..... G09G 3/3233 345/76
2008/0204378 A1 * 8/2008 Park ..... G09G 3/3208 345/77
2010/0002148 A1 * 1/2010 Otawara ..... G09G 3/2081 348/678

(Continued)

FOREIGN PATENT DOCUMENTS

JP H11-231838 A 8/1999

*Primary Examiner* — Thuy N Pardo
(74) *Attorney, Agent, or Firm* — K&L Gates LLP

(57) ABSTRACT

A display device includes: a display unit including pixels each including a holding circuit that holds a pixel signal; a driver that drives the pixels based on image signals and supply the pixel signal to the holding circuit of each pixel; an encoding circuit that encodes the image signals on a frame basis; storage that stores data resulting from encoding; a determination circuit that determines whether the image signals for consecutive frames are moving image signals or still image signals; and a controller that controls the driver based on the image signals and the result of the determination circuit. The controller brings the driver into a first state for driving the pixels based on the image signals when the result indicates the moving image signals, and into a second state for causing at least part of the driver to stop operating when the result indicates the still image signals.

5 Claims, 12 Drawing Sheets

(56) References Cited

U.S. PATENT DOCUMENTS

| | | | | |
|---|---|---|---|---|
| 2011/0141088 | A1* | 6/2011 | Jeon | G09G 3/3611 345/211 |
| 2011/0205259 | A1* | 8/2011 | Hagood, IV | G09G 3/3413 345/690 |
| 2012/0320112 | A1* | 12/2012 | Hagood, IV | G02B 26/004 345/690 |
| 2012/0320113 | A1* | 12/2012 | Hagood, IV | G02B 26/004 345/690 |
| 2013/0082607 | A1* | 4/2013 | Gandhi | G09G 3/3433 315/153 |
| 2014/0049571 | A1* | 2/2014 | Erinjippurath | G09G 3/3607 345/690 |
| 2015/0062111 | A1* | 3/2015 | Roh | G09G 5/12 345/213 |
| 2017/0186364 | A1* | 6/2017 | Okamoto | H01L 29/7869 345/55 |
| 2017/0186365 | A1* | 6/2017 | Yoneda | H04N 19/513 345/55 |

* cited by examiner

DISPLAY DEVICE AND IMAGE DETERMINATION DEVICE

CROSS-REFERENCE TO RELATED APPLICATIONS

This application claims priority from Japanese Application No. 2018-087714, filed on Apr. 27, 2018, the contents of which are incorporated by reference herein in its entirety.

BACKGROUND

1. Technical Field

The present disclosure relates to a display device and an image determination device.

2. Description of the Related Art

Japanese Patent Application Laid-open Publication No. 11-231838 (JP-A-11-231838) describes a display device that operates differently between when an input image is a moving image and when it is a still image.

To determine whether an input image is a moving image or a still image, the display device described in JP-A-11-231838 uses an adder that determines input signals to be 0 or 1 on a pixel basis and adds up the input signals of one screen. This method, however, has a non-negligible possibility of erroneously recognize images of two consecutive frames as identical images although they are different images. Assuming that one of two frame images is a symmetrical image to the other (an image obtained by inverting pixel positions in a vertical synchronization direction, a horizontal synchronization direction, or both of the synchronization directions), the images are erroneously recognized as consecutive identical images in determination performed by the adder. Furthermore, assuming that the brightness and the intensity of contrast of the whole images change between the two frames within a range where the number of lighting pixels determined by 0 or 1 does not change, the images are erroneously recognized as consecutive identical images in determination performed by the adder.

For the foregoing reasons, there is a need for a display device and an image determination device that can distinguish between a moving image and a still image with higher accuracy.

SUMMARY

According to an aspect, a display device includes: a display unit including a plurality of pixels, each pixel including a holding circuit configured to hold an electric potential that is input as a pixel signal; a driver configured to drive the pixels based on image signals and supply the pixel signals to the holding circuits of the respective pixels; an encoding circuit configured to encode the image signals on a frame basis; storage configured to store therein a plurality of pieces of data resulting from encoding on a frame basis; a determination circuit configured to compare the pieces of data and determine whether the image signals for a plurality of consecutive frames are moving image signals or still image signals; and a controller configured to control the driver based on the image signals and the determination result of the determination circuit. The controller brings the driver into a first state for driving the pixels based on the image signals when the result of the determination circuit indicates the moving image signals. The controller brings the driver into a second state for causing at least part of the driver to stop operating when the result of the determination circuit indicates the still image signals.

DETAILED DESCRIPTION

Figure 1:
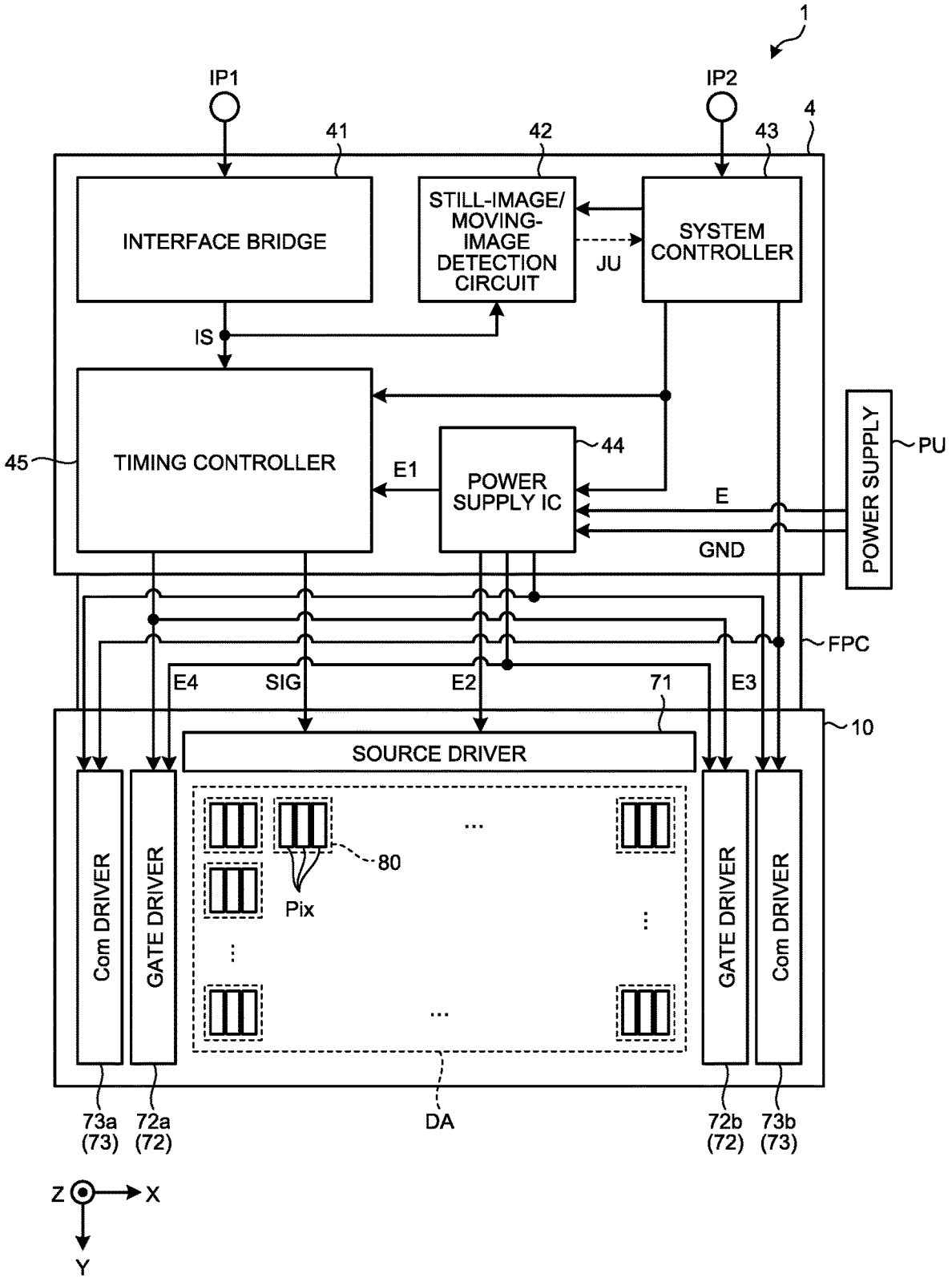
FIG. 1 is a block diagram of a main configuration included in a display device according to an embodiment.

Exemplary embodiments according to the present invention are described below with reference to the accompanying drawings. What is disclosed herein is given by way of example only, and appropriate changes made without departing from the spirit of the invention and easily conceivable by those skilled in the art naturally fall within the scope of the present invention. To simplify the explanation, the drawings may possibly illustrate the width, the thickness, the shape, and other elements of each component more schematically than the actual aspect. These elements, however, are given by way of example only and are not intended to limit interpretation of the present invention. In the present specification and the figures, components similar to those previously described with reference to previous figures are denoted by the same reference numerals, and detailed explanation thereof may be appropriately omitted.

In this disclosure, when an element is described as being "on" another element, the element can be directly on the other element, or there can be one or more elements between the element and the other element.

FIG. 1 is a block diagram of a main configuration included in a display device 1 according to an embodiment. The display device 1 includes a circuit substrate 4 and a display panel 10. The circuit substrate 4 and the display panel 10 illustrated in FIG. 1 are coupled via wiring of flexible printed circuits (FPC). The wiring of the FPC can be appropriately replaced by wiring included in other components, such as wiring of a cable. Alternatively, the circuit substrate 4 and the substrate of the display panel 10 may be integrally configured without any wiring, such as FPC, provided therebetween.

The circuit substrate 4 includes an interface bridge 41, a still-image/moving-image detection circuit 42, a system controller 43, a power supply IC 44, and a timing controller 45.

The interface bridge 41 is coupled to an interface that receives first input signals IP1 from outside. Examples of the interface include, but are not limited to, High Definition Multimedia Interface (HDMI, a registered trademark), Digital Visual Interface (DVI), DisplayPort (a registered trademark), etc. The interface bridge 41 generates image signals IS according to another standard based on the first input signals IP1 input via the interface. Examples of another standard include, but are not limited to, a standard more suitable for data transmission in the display device 1, such as Low Voltage Differential Signaling (LVDS), etc. The interface on the input side and the standard on the output side of the interface bridge 41 are not limited thereto and may be appropriately replaced by others used for the same purpose. As described above, the interface bridge 41 converts the first input signals IP1 into the image signals IS in a format that can be supported by the still-image/moving-image detection circuit 42 and the timing controller 45.

While the first input signals IP1 according to the embodiment are digital signals, they may be analog signals. If the first input signals IP1 are analog signals, an analog-digital (A-D) conversion circuit is provided to convert the analog signals into digital signals. The A-D conversion circuit is provided between the interface bridge 41 and the interface that receives the first input signals IP1 or in the interface bridge 41.

The interface bridge 41 continuously receives the first input signals IP1 for creating frame images with a predetermined frequency (with a predetermined period). Examples of the predetermined frequency include, but are not limited to, 60 Hz, 120 Hz, 144 Hz, 244 Hz, etc. The predetermined frequency (predetermined period) is determined in advance and appropriately set depending on the performance of the display device 1. The interface bridge 41 outputs the image signals IS corresponding to a refresh rate of the predetermined frequency (predetermined period).

The still-image/moving-image detection circuit (determination circuit) 42 receives the image signals IS output from the interface bridge 41. The still-image/moving-image detection circuit 42 determines whether a plurality of frame images produced based on the image signals IS received from the interface bridge 41 are moving images or still images. If the still-image/moving-image detection circuit 42 according to the embodiment determines that the frame images are still images, the still-image/moving-image detection circuit 42 outputs a determination signal JU. The determination signal JU is a signal indicating that the frame images produced based on the image signals IS from the interface bridge 41 are still images. The still-image/moving-image detection circuit 42 will be described later in detail.

The system controller (controller) 43 is coupled to an interface that receives second input signals IP2 from outside. The interface is used to input commands to the display device 1. Examples of the interface include, but are not limited to, Inter-Integrated Circuit ($I^2C$, a registered trademark), Serial Peripheral Interface (SPI), etc. The system controller 43 controls operations of other circuits based on the second input signals IP2. The other circuits include the still-image/moving-image detection circuit 42, the power supply IC (power supply circuit) 44, and the timing controller 45, for example.

The power supply IC 44 is an IC (integrated circuit) that supplies electric power to the units of the display device 1. The power supply IC 44 is a circuit that supplies electric power E1, E2, and E3, for example, suitable for the respective components of the display device 1 based on electric power E supplied from an external power supply PU coupled to the circuit substrate 4. A ground potential (GND) in the display device 1 according to the embodiment is supplied by coupling to the power supply PU.

The timing controller 45 outputs signals to the display panel 10 based on the image signals IS received from the interface bridge 41, thereby controlling a timing for updating display of an image by the display panel 10. In other words, when the display panel 10 displays a moving image, the timing controller 45 outputs signals such that the moving image frames are switched with the predetermined period.

The display panel 10 includes pixels Pix disposed in a display region DA, a source driver 71, a gate driver 72, and a Com driver 73. The source driver 71, the gate driver 72, and the Com driver 73 are circuits relating to operations of the pixels Pix and disposed in a peripheral region of the display region DA.

In the display region DA, a plurality of pixels Pix are disposed in a matrix (row-column configuration) of N columns (N is a natural number) in an X-direction and M rows (M is a natural number) in a Y-direction. The X-direction is parallel to principle surfaces of a first panel 2 and a second panel 3. The Y-direction is parallel to the principle surfaces of the first panel 2 and the second panel 3 and intersects the X-direction. As described above, the display panel 10 including the display region DA provided with the pixels Pix serves as a display unit.

The M×N pixels Pix each face a color filter 22 (refer to FIG. 2) in any one of R (red), G (green), and B (blue). The color filter 22 may have four colors including W (white), in addition to R (red), G (green), and B (blue) or four colors not including W (white). Alternatively, the color filter 22 may have five or more different colors.

Figure 2:
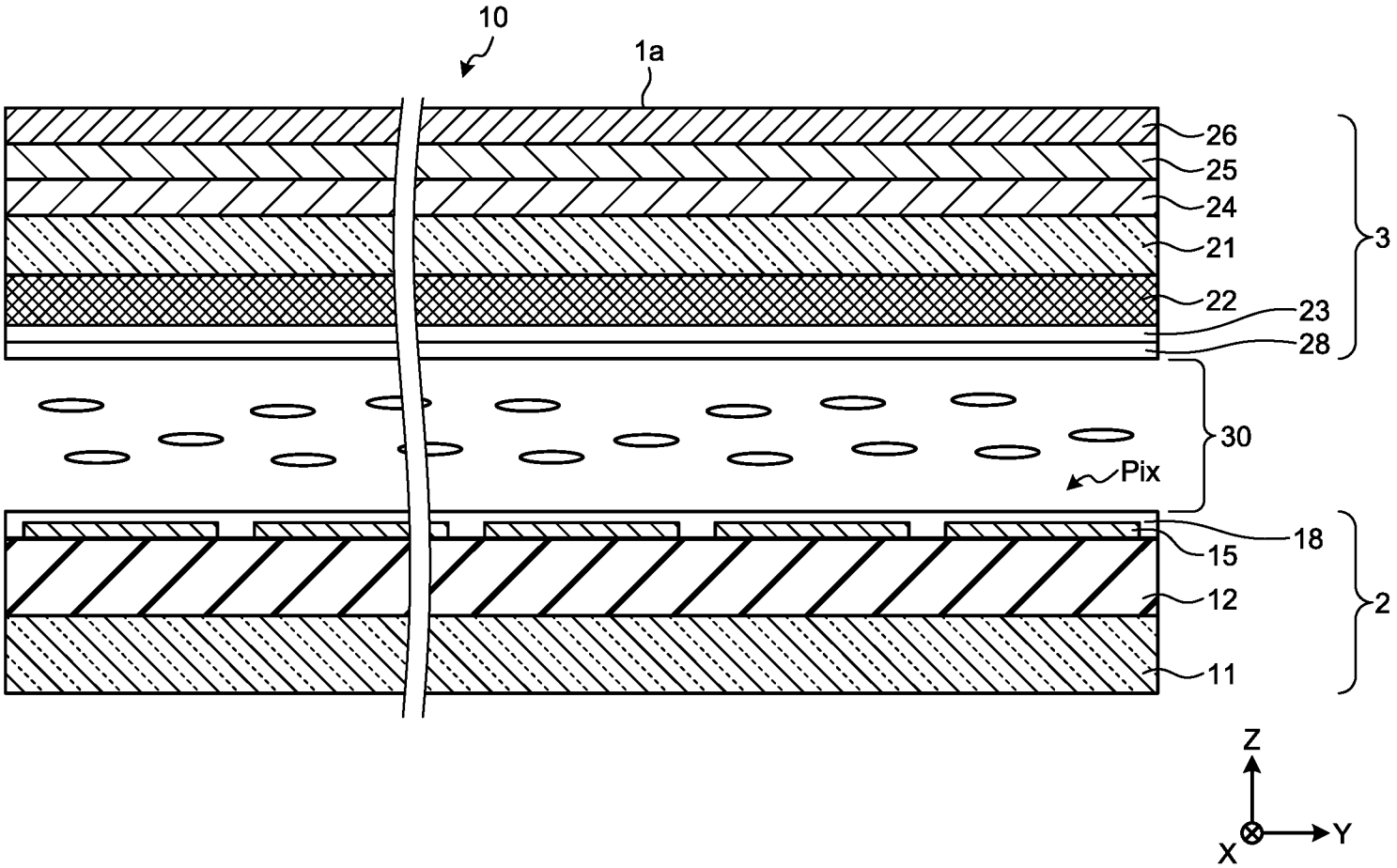
FIG. 2 is a sectional view of a display panel.

FIG. 2 is a sectional view of the display panel 10. As illustrated in FIG. 2, the display panel 10 includes the first panel 2, the second panel 3, and a liquid crystal layer 30. The second panel 3 is disposed facing the first panel 2. The liquid crystal layer 30 is provided between the first panel 2 and the second panel 3. A surface serving as a principle surface of the second panel 3 corresponds to a display surface 1*a* for displaying images.

Light entering from outside of the display surface 1*a* is reflected by reflective electrodes 15 of the first panel 2 and exits from the display surface 1*a*. The display panel 10 according to the embodiment is an image display panel of a reflective liquid crystal display device that displays images on the display surface 1*a* using the reflected light. As described above, the pixels Pix each include the reflective electrode 15 that reflects light entering from outside. In the present specification, the X-direction is a direction parallel to the display surface 1*a*, the Y-direction is a direction intersecting the X-direction in a plane parallel to the display surface 1*a*, and a Z-direction is a direction perpendicular to the display surface 1*a*.

The first panel 2 includes a first substrate 11, an insulating layer 12, the reflective electrodes 15, and an orientation film 18. The first substrate 11 is a glass or resin substrate, for example. The surface of the first substrate 11 is provided with circuit elements and various kinds of wiring, such as scanning lines GCL (refer to FIG. 3) and signal lines SGL (refer to FIG. 3), which are not illustrated in FIG. 2. The circuit elements include switching elements 51, such as TFT (thin-film transistors).

The insulating layer 12 is provided on the first substrate 11 and collectively planarizes the surfaces of the circuit elements and the various kinds of wiring. The reflective electrodes 15 are provided on the insulating layer 12. The orientation film 18 is provided between the reflective electrodes 15 and the liquid crystal layer 30. The reflective electrodes 15 have a rectangular shape and are provided to the respective pixels Pix. The reflective electrodes 15 are made of metal, such as aluminum (Al) and silver (Ag). The reflective electrodes 15 may have a multilayered structure obtained by laminating the metal material and a translucent conductive material, such as ITO (indium tin oxide). The reflective electrodes 15 are made of a material having high reflectance and serve as reflective plates that diffuse and reflect light entering from outside.

The light reflected by the reflective electrodes 15 is scattered by diffuse reflection but travels in a uniform direction toward the display surface 1*a*. By changing the level of voltage applied to each of the reflective electrodes 15, the transmission state of light in the liquid crystal layer 30 on the reflective electrode, that is, the transmission state of light in the corresponding pixel Pix changes. In other words, the reflective electrodes 15 also serve as pixel electrodes.

The second panel 3 includes a second substrate 21, the color filter 22, common electrodes 23, an orientation film 28, a quarter wavelength plate 24, a half wavelength plate 25, and a polarizing plate 26. The color filter 22 and the common electrodes 23 are provided in this order on one of both surfaces of the second substrate 21, the one surface facing the first panel 2. The orientation film 28 is provided between the common electrodes 23 and the liquid crystal layer 30. The quarter wavelength plate 24, the half wavelength plate 25, and the polarizing plate 26 are stacked in this order on the other surface of the second substrate 21 on the display surface 1*a* side.

The second substrate 21 is a glass or resin substrate, for example. The common electrodes 23 are made of a translucent conductive material, such as ITO. The common electrodes 23 are disposed facing the reflective electrodes 15 and supply a common potential to the pixels Pix.

The liquid crystal layer 30 includes nematic liquid crystals, for example. By changing the level of voltage between the common electrodes 23 and the reflective electrodes 15, the orientation state of liquid crystal molecules changes in the liquid crystal layer 30. With this mechanism, the display device 1 modulates light passing through the liquid crystal layer 30 on a pixel Pix basis.

Light, such as external light, enters from the display surface 1*a* of the display panel 10. The entering light passes through the second panel 3 and the liquid crystal layer 30, and then reaches the reflective electrodes 15. The entering light is reflected by the reflective electrodes 15 of the respective pixels Pix. The reflected light is modulated on a pixel Pix basis and exits from the display surface 1*a*. An image is thus displayed.

Figure 3:
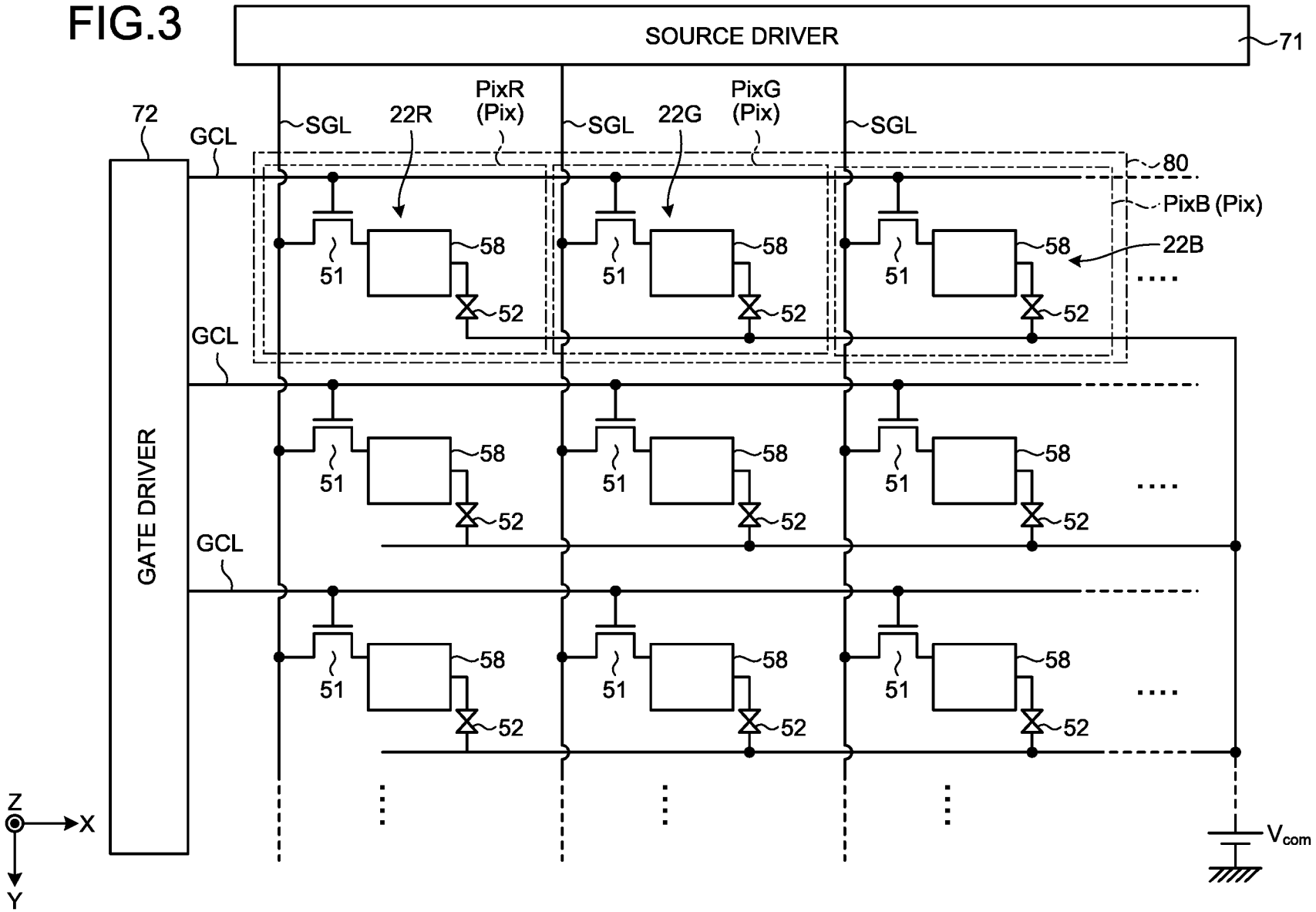
FIG. 3 is a circuit diagram of a basic pixel circuit relating to pixels.

Colors of the reflected light that exits from the display surface 1*a* correspond to the colors included in the color filter 22. As illustrated in FIG. 3, which will be described later, the color filter 22 has three color regions: a red (R) color region 22R, a green (G) color region 22G, and a blue (B) color region 22B, for example, but the present disclosure is not limited thereto.

FIG. 3 is a circuit diagram of a basic pixel circuit relating to the pixels Pix. The first substrate 11 illustrated in FIG. 2 is provided with the switching elements 51 of the respective pixels Pix and wiring, such as the signal lines SGL and the scanning lines GCL. The signal lines SGL supply pixel signals SIG (refer to FIGS. 1 and 4) to the reflective electrodes 15. The scanning lines GCL supply drive signals for driving the switching elements 51. The signal lines SGL and the scanning lines GCL extend along a plane parallel to the surface of the first substrate 11.

As illustrated in FIG. 3, the pixels Pix each include the switching element 51, a liquid crystal element 52, and a holding circuit 58. The switching element 51 is fabricated using a thin-film transistor. In this example, the switching element 51 is fabricated using an n-channel MOS (metal oxide semiconductor) TFT. The liquid crystal element 52 includes liquid crystal capacitance generated between the reflective electrode 15 and the common electrode 23. The holding circuit 58 will be described later (refer to FIG. 4).

The scanning lines GCL are coupled to the gate driver 72. The gate driver 72 sequentially scans the scanning lines GCL. The gate driver 72 applies scanning signals Vscan to the gates of the switching elements 51 via the scanning line GCL, thereby sequentially selecting one row (one horizontal line) out of the pixels Pix. An electric potential (VGH) of the scanning line GCL obtained when the scanning signal Vscan is applied is higher than an electric potential (VGL) obtained when the scanning signal Vscan is not applied. The signal lines SGL are coupled to the source driver 71. The source driver 71 supplies the pixel signals SIG to the pixels Pix constituting the selected horizontal line via the signal lines SGL. These pixels Pix perform display on a horizontal line basis based on the supplied pixel signals SIG. The Com driver 73 (refer to FIG. 1) applies common signals having a common potential $V_{com}$ to the common electrodes 23. The Com driver 73 supplies display signals or inversion display signals to the reflective electrodes 15 of the respective pixels Pix via FRP wiring or xFRP wiring (which will be described later).

The timing controller 45 (refer to FIG. 1) controls the timing at which the source driver 71 supplies the pixel signals SIG and the timing at which the gate driver 72 supplies the scanning signals Vscan. The pixel signals SIG output from the source driver 71 correspond to signals output from the timing controller 45 to the source driver 71 based on the image signals IS. The signals output from the timing controller 45 to the source driver 71 include the pixel signals SIG. As described above, the timing controller 45 generates the pixel signals SIG for individually driving the pixels Pix based on the image signals IS. The source driver 71 is coupled to the pixels Pix via the signal lines SGL and serves as a signal output circuit that supplies the pixel signals SIG to the pixels Pix. The gate driver 72 is coupled to the pixels Pix via the scanning lines GCL and serves as a scanning circuit that drives the pixels Pix to which the pixel signals SIG are supplied. The timing controller 45 and the source driver 71 serve as a driver D (refer to FIG. 7) that drives the pixels Pix based on the image signals IS.

The gate driver 72 illustrated in FIG. 1 includes gate drivers 72*a* and 72*b* provided at respective ends of the display region DA in the X-direction. The Com driver 73 illustrated in FIG. 1 includes Com drivers 73*a* and 73*b* provided at respective ends of the display region DA in the X-direction. As illustrated in FIG. 1, the circuits are each provided at respective ends facing across the display region DA. This configuration can further stabilize the electric potential of the scanning signals Vscan output from the gate driver 72 and the electric potential of the common potential $V_{com}$ output from the Com driver 73. The Com drivers 73*a* and 73*b* may be provided at respective ends of the display region DA in the Y-direction.

The R (red) color region 22R, the G (green) color region 22G in, and the B (blue) color region 22B in included in the color filter 22 are provided to the respective pixels Pix illustrated in FIG. 3. A set of pixels PixR, PixG, and PixB corresponding to the color regions 22R, 22G, and 22B in the three colors, respectively, serves as a unit pixel 80. The unit pixel 80 serves as the smallest unit that performs color reproduction corresponding to the first input signals IP1 based on an RGB color model. With this configuration, the display panel 10 can support color display.

Figure 4:
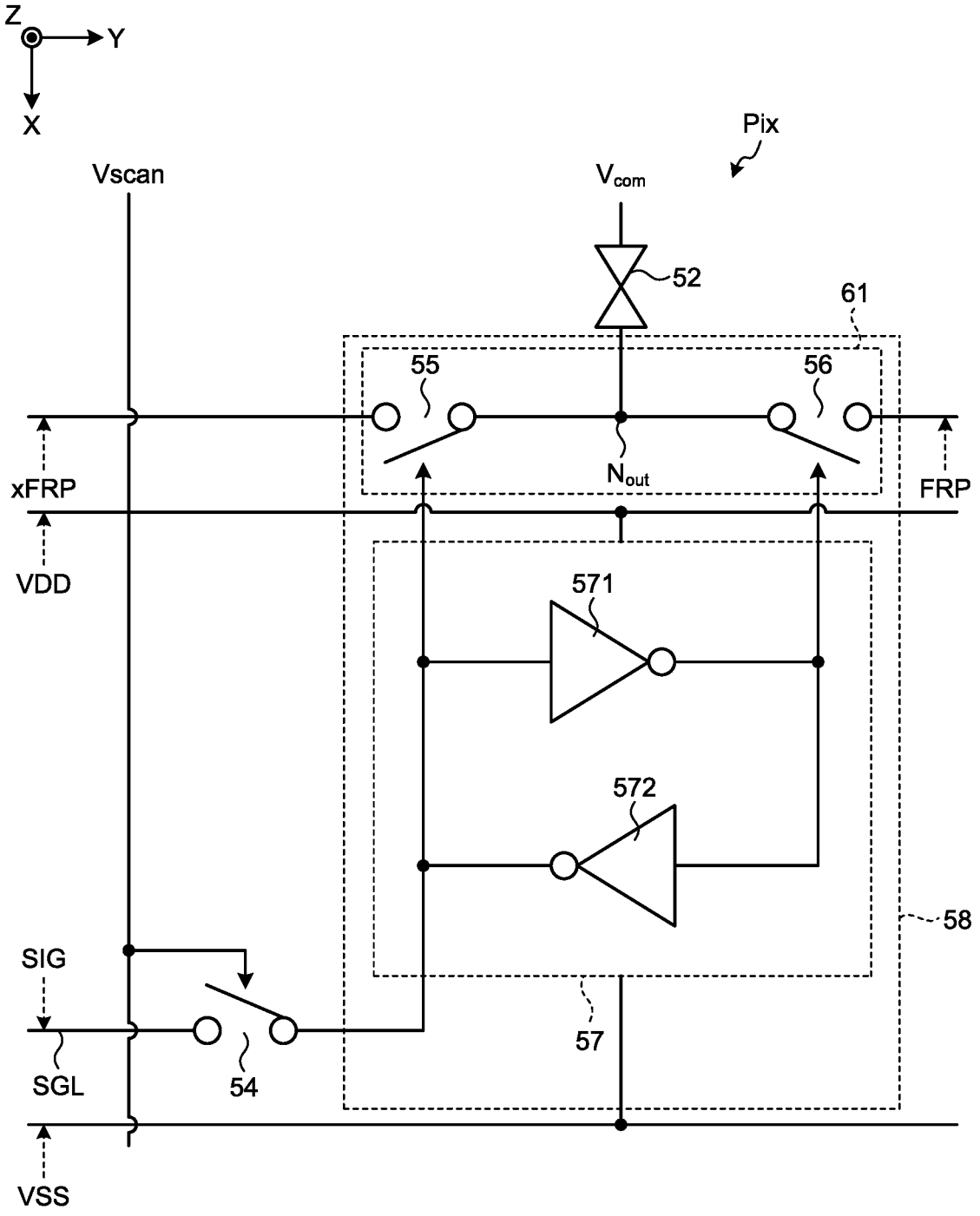
FIG. 4 is a block diagram of an exemplary circuit configuration of a pixel Pix.
Figure 5:
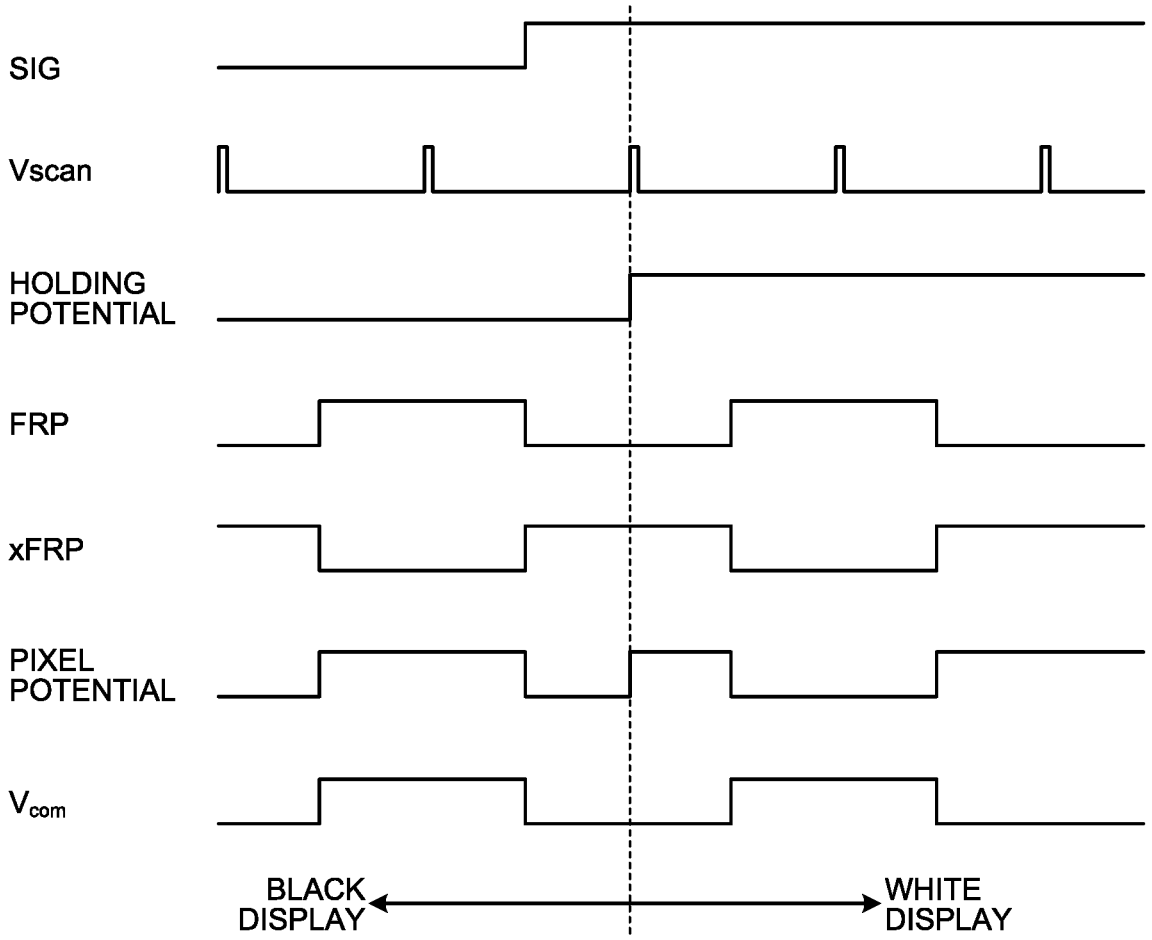
FIG. 5 is a timing chart for explaining operations of the pixel employing an MIP technology.

FIG. 4 is a block diagram of an exemplary circuit configuration of the pixel Pix. FIG. 5 is a timing chart for explaining operations of the pixel Pix employing an MIP technology. The pixel Pix has a memory function capable of storing therein data by Memory-in-pixel (MIP) technology.

As illustrated in FIG. 4, the pixel Pix includes the holding circuit 58. The holding circuit 58 includes a memory cell (MIP) 57 and a selection switching circuit 61 coupled to the switching element 51. The selection switching circuit 61 includes switches 55 and 56. The memory cell 57 has a static random access memory (SRAM) function.

The switching element 51 is coupled to the signal line SGL. When being supplied with the scanning signal Vscan from the gate driver 72 (refer to FIGS. 1 and 3), the switching element 51 is turned ON (closed state). In other words, the electric potential VGH of the scanning signal Vscan is a gate-on potential, whereas the electric potential VGL obtained when the scanning signal Vscan is not applied is a gate-off potential. The source driver 71 (refer to FIGS. 1 and 3) supplies the pixel signal SIG to the memory cell 57 via the signal line SGL and the switching element 51. The memory cell 57 includes inverters 571 and 572 coupled in parallel in opposite directions. The memory cell 57 serves as a latch circuit that holds (latches) the electric potential corresponding to the pixel signal SIG. The electric potential of the memory cell 57 is held based on electric power from a power supply line VDD for a high potential and a power supply line VSS for a low potential. The power supply IC 44 (refer to FIG. 1) supplies electric power to the power supply line VDD for a high potential and the power supply line VSS for a low potential.

The selection switching circuit 61 selects an electric potential to be supplied to the reflective electrode 15 based on the pixel signal (which may be hereinafter referred to as a holding potential) SIG held in the memory cell 57. The selection switching circuit 61 includes a pair of switches 55 and 56. The first switch 55 is provided between the xFRP wiring and the reflective electrode 15. The second switch 56 is provided between the FRP wiring and the reflective electrode 15. The first switch 55 is controlled and turned ON and OFF based on the electric potential of an output node of the inverter 572. Specifically, when the electric potential of the output node of the inverter 572 is H, the first switch 55 is ON, thereby coupling the xFRP wiring to the reflective electrode 15. When the electric potential of the output node is L, the first switch 55 is OFF. The second switch 56 is controlled and turned ON and OFF based on the electric potential of an output node of the inverter 571. Specifically, when the electric potential of the output node of the inverter 571 is H, the second switch 56 is ON, thereby coupling the FRP wiring to the reflective electrode 15. When the electric potential of the output node is L, the second switch 56 is OFF. As illustrated in FIG. 1, the Com driver 73 supplies the display signal to the xFRP wiring coupled to the first switch 55. The display signal maintains an electric potential in opposite phase with the common potential $V_{com}$. The Com driver 73 also supplies the inversion display signal to the FRP wiring coupled to the second switch 56. The inversion display signal maintains an electric potential in phase with the common potential $V_{com}$. It is preferred that the common potential and the electric potential due to the inversion display signal be always exactly the same potential. As described above, one of the switches 55 and 56 is turned ON depending on the polarity of the holding potential in the memory cell 57. As a result, the reflective electrode 15 in the liquid crystal element 52 arranged corresponding to the common electrode 23 supplied with the common electrode $V_{com}$ is supplied with the electric potential in phase with the common potential $V_{com}$ from the FRP wiring or the electric potential in opposite phase with the common potential $V_{com}$ from the xFRP wiring. The other terminals of the switches 55 and 56 are coupled to a common coupling node. The common coupling node corresponds to an output node $N_{out}$ of the present pixel circuit. The display signal supplied to the xFRP wiring may be an alternating current (AC) signal having a predetermined effective value voltage and a predetermined amplitude. In this case, the inversion display signal supplied to the FRP wiring and the common signal supplied to the common electrode are AC signals having an inverted phase with respect to the xFRP signal (or AC signals in opposite phase with the xFRP signal). Alternatively, the FRP signal and the common electrode may be direct current (DC) signals having a predetermined electric potential.

As illustrated in FIG. 5, when the holding potential in the memory cell 57 has a negative polarity (the electric potential of the output node of the inverter 571 is H, and the electric potential of the output node of the inverter 572 is L), the pixel potential of the liquid crystal element 52 is in phase with the common electrode $V_{com}$, thereby performing black display. When the holding potential in the memory cell 57 has a positive polarity (the electric potential of the output node of the inverter 571 is L, and the electric potential of the output node of the inverter 572 is H), the pixel potential of the liquid crystal element 52 is in opposite phase with the common electrode $V_{com}$, thereby performing white display. Black display indicates display performed when the reflected light from the reflective electrode 15 of the pixel Pix is at the minimum. White display indicates display performed when the reflected light from the reflective electrode 15 of the pixel Pix is at the maximum.

As described above, in the pixel Pix, one of the switches 55 and 56 is turned ON depending on the polarity of the holding potential in the memory cell 57. Consequently, an electric potential in phase with or in opposite phase with the common potential $V_{com}$ is applied to the reflective electrode 15 via the FRP wiring or the xFRP wiring. As a result, a constant voltage is always applied to the pixel Pix, thereby suppressing shading. In other words, the memory cell 57 holds an electric potential corresponding to the latest pixel signal SIG. As described above, the holding circuit 58 has a function of holding the last electric potential input to the pixel Pix.

With the pixels Pix each including the memory cell 57 that stores therein data, the MIP technology according to the present embodiment can perform display in a digital display mode and a memory display mode. The digital display mode is a display mode of switching the pixel signals SIG stored in the memory cells 57 of the respective pixels Pix in each frame period, thereby switching display in the pixels Pix in each frame. The memory display mode is a display mode of not switching the pixel signals SIG stored in the memory cells 57 included in the respective pixels Pix in each frame but maintaining the display state of the pixels Pix for a predetermined duration (e.g., a duration of a plurality of frame periods in the digital display mode) based on the pixel signals SIG stored in the memory cells 57.

Also in the digital display mode, the display device 1 stores the pixel signals SIG in the memory cells 57 but changes the pixel signals SIG in each frame period (refresh). In the memory display mode, the display device 1 need not perform an operation of writing the pixel signals SIG in each frame period because it uses the pixel signals SIG stored in the memory. As a result, the memory display mode requires lower power consumption than the digital display mode, thereby reducing power consumption of the display device 1. In the present embodiment, the digital display mode is a display mode in a first state, and the memory display mode is a display mode in a second state.

While the pixel Pix according to the present embodiment includes an SRAM, it may include another memory, such as a dynamic random access memory (DRAM). Instead of the pixel Pix including the memory cell 57, a pixel Pix provided with a known memory liquid crystal, for example, may be used as the pixel Pix having a memory function.

The display modes of liquid crystals include a normally white mode and a normally black mode. The normally white mode is a mode of performing white display when no electric field (voltage) is applied and performing black display when an electric field is applied. The normally black mode is a mode of performing black display when no electric field is applied and performing white display when an electric field is applied. These modes are the same in the structure of the liquid crystal cell and different in the position of the polarizing plate 26 illustrated in FIG. 2. The display device 1 according to the present embodiment is driven by the normally black mode performing black display when no electric field (voltage) is applied and performing white display when an electric field is applied.

The following describes control on power consumption of the display device 1 based on determination of an image performed by the still-image/moving-image detection circuit 42 with reference to FIGS. 6 to 12.

Figure 6:
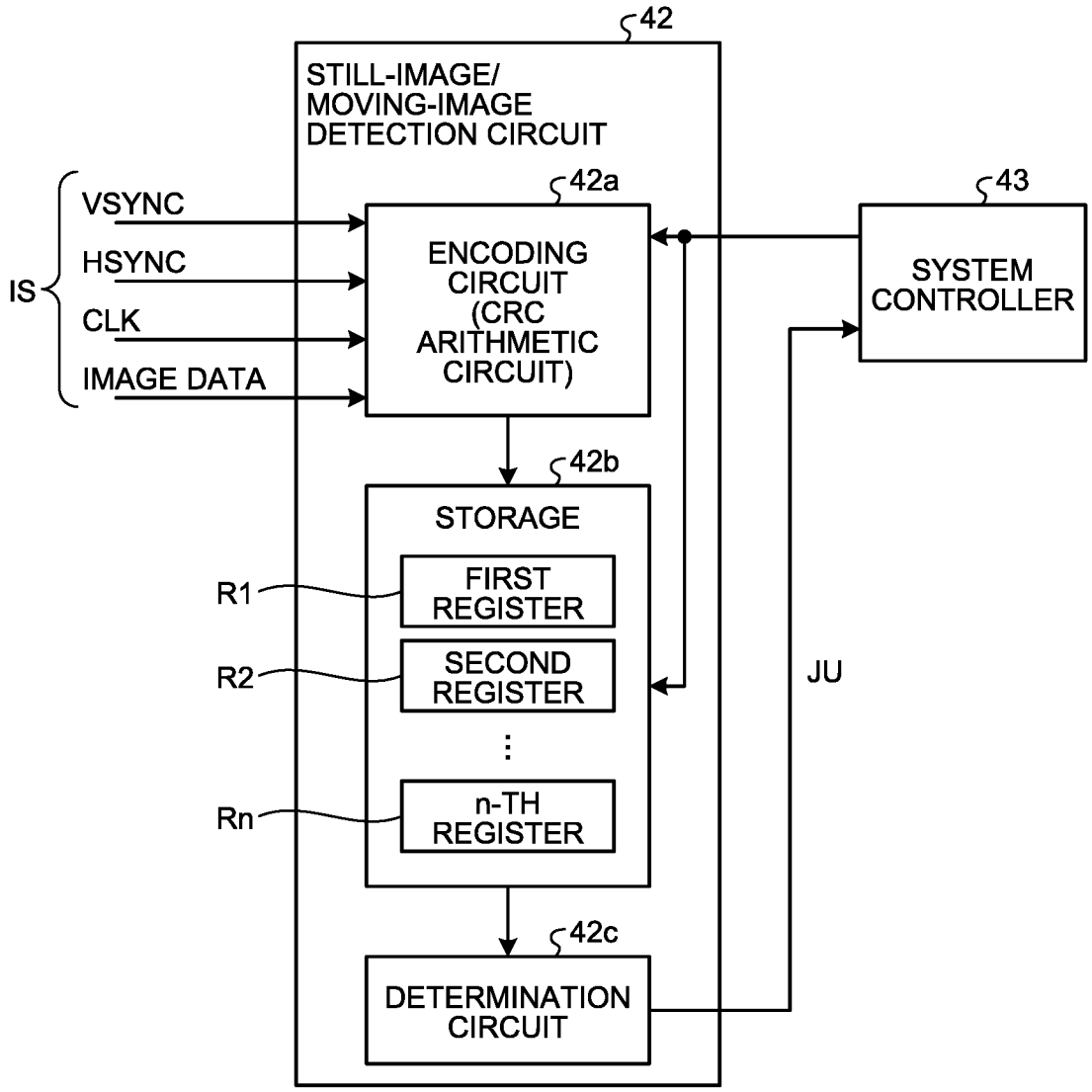
FIG. 6 is a block diagram of a main functional configuration of a still-image/moving-image detection circuit.

FIG. 6 is a block diagram of a main functional configuration of the still-image/moving-image detection circuit 42. The still-image/moving-image detection circuit 42 includes an encoding circuit 42*a*, storage 42*b*, and a determination circuit 42*c*. The encoding circuit 42*a* encodes the image signals IS of a plurality of frames on a frame basis. As illustrated in FIG. 6, the image signal IS includes a vertical synchronization signal VSYNC, a horizontal synchronization signal HSYNC, a clock signal CLK, and image data. The vertical synchronization signal VSYNC is input prior to image data of one frame. In other words, the vertical synchronization signal VSYNC serves as a signal that divides the image signals IS of a plurality of frames such that each image signal of one frame is separated from one another. The encoding circuit 42*a* defines the image signal IS including image data input after a certain vertical synchronization signal VSYNC and before the next vertical synchronization signal VSYNC as the image signal IS of one frame. The encoding circuit 42*a* encodes each image signal IS of one frame acquired as described above. The horizontal synchronization signal HSYNC is not necessarily input to the encoding circuit 42*a*.

The encoding circuit 42*a* according to the present embodiment is a CRC arithmetic circuit that encodes the image signals IS by Cyclic redundancy check (CRC) technique. Specifically, the encoding circuit 42*a* generates a CRC code corresponding to the image signal IS of one frame for each frame image included in the image signals IS of a plurality of frames. The CRC employed in the present embodiment may be CRC-16, CRC-32, or CRC by other techniques. The technique employed in encoding performed by the encoding circuit 42*a* is not limited to CRC and may be a technique for encoding other error-detecting codes.

The following describes the CRC technique. In the CRC technique, a remainder obtained by dividing a digital signal (image signal IS) prior to encoding by a bit pattern corresponding to a predetermined polynomial is handled as data resulting from encoding. A polynomial used when CRC-16 is employed is represented by Expression (1), for example. A polynomial used when CRC-32 is employed is represented by Expression (2), for example. As the length of the bit pattern corresponding to the polynomial increases, the accuracy increases in determining whether two pieces of data resulting from encoding are identical.

$$X^{16}+X^{15}+X^{2}+1 \tag{1}$$

$$X^{32}+X^{26}+X^{23}+X^{22}+X^{16}+X^{12}+X^{11}+X^{10}+X^{8}+X^{7}+X^{5}+X^{4}+X^{2}+X+1 \tag{2}$$

The storage 42*b* stores therein data resulting from encoding the image signal IS of a plurality of frames. As illustrated in FIG. 6, the storage 42*b* includes a first register R1, a second register R2, . . . , and an n-th register Rn. Each of the first register R1, the second register R2, . . . , and the n-th register Rn is a storage circuit (register) that stores therein CRC encoded data corresponding to the image signal IS of one frame. n is a natural number larger than or equal to 2. When n=2 is satisfied, the storage 42*b* includes the first register R1 and the second register R2. When n=5 is satisfied, the storage 42*b* includes the first register R1, the second register R2, . . . , and a fifth register R5. When a natural number m satisfies a frame corresponding to CRC encoded data stored in an (m+1)-th register R(m+1) is a frame p frames after a frame corresponding to CRC encoded data stored in an m-th register Rm. p is a natural number. After the pieces of CRC encoded data corresponding to the image signals IS up to the n-th frame are stored in the first register R1, . . . , and the n-th register Rn, CRC encoded data corresponding to an n+p-th frame is stored in the first register R1 in an overwriting manner.

The determination circuit 42*c* compares the pieces of data resulting from encoding on a frame basis and determines whether the image signals IS of a plurality of frames are moving image signals or still image signals. To perform the determination, the determination circuit 42*c* reads n pieces of data stored in n registers from the first register R1 to the n-th register Rn. The n pieces of data are data resulting from encoding the image signals IS of n frames on a frame basis. The determination circuit 42*c* determines whether all the n pieces of data are identical data. If all the n pieces of data are identical data, the determination circuit 42*c* determines that the image signals IS of the n frames corresponding to the n pieces of data are still image signals. If all the n pieces of data are not identical data, the determination circuit 42*c* determines that the image signals IS of the n frames corresponding to the n pieces of data are moving image signals. If it is determined that the image signals IS of the n frames are still image signals, the determination circuit 42*c* according to the embodiment outputs the determination signal JU. As described above, the configuration (e.g., the circuit substrate 4) provided with the still-image/moving-image detection circuit 42 including the encoding circuit 42*a*, the storage 42*b*, and the determination circuit 42*c* serves as an image determination device.

In the embodiment, the clock signal CLK included in the image signal IS synchronizes with the clock signal CLK output from the system controller 43. The system controller 43 outputs commands for controlling operations of the encoding circuit 42*a* and the storage 42*b* based on the second input signals IP2. The encoding circuit 42*a* operates based on the commands and encodes the image signals IS. The storage 42*b* operates in synchronization with the encoding circuit 42*a* based on the commands and shifts the register in which data corresponding to the latest image signal IS resulting from encoding is to be stored. Storing new data in the storage 42*b* triggers the determination circuit 42*c* to operate, such that the determination circuit 42*c* reads the n pieces of data stored in the registers and determines whether all the pieces of data are identical data.

Figure 7:
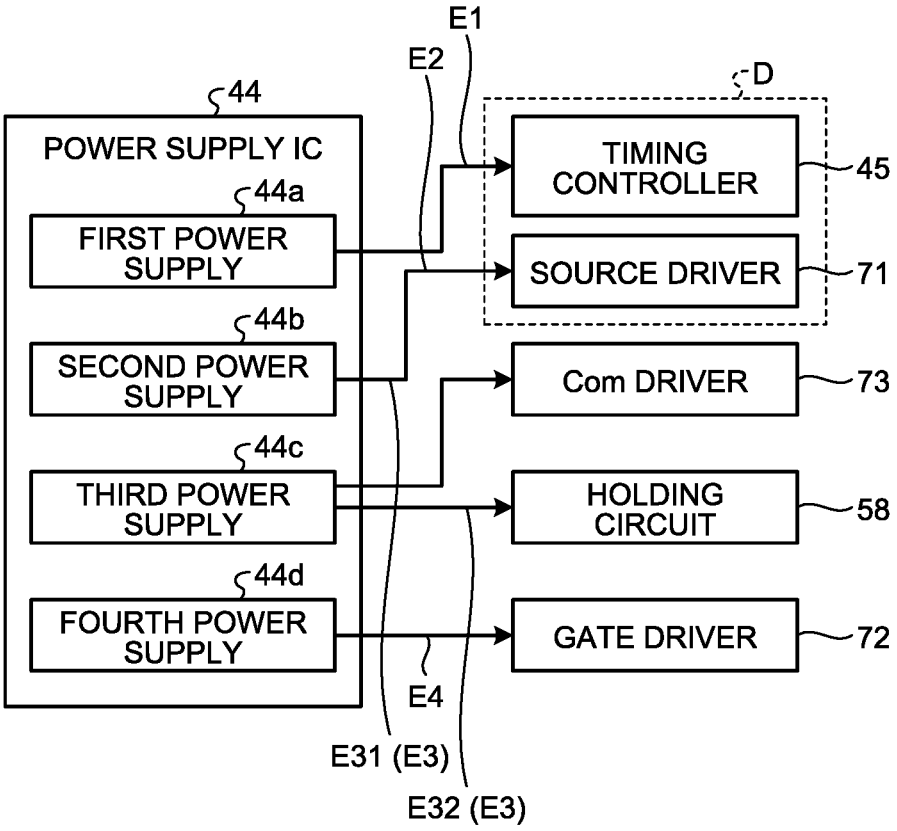
FIG. 7 is a schematic block diagram of electric power systems included in a power supply IC.

FIG. 7 is a schematic block diagram of electric power systems included in the power supply IC 44. The power supply IC 44 includes a first power supply 44*a*, a second power supply 44*b*, and a third power supply 44*c*, for example. The first power supply 44*a* supplies electric power E1 to cause the timing controller 45 to operate. The second power supply 44*b* supplies electric power E2 to cause the source driver 71 to operate. The third power supply 44*c* supplies electric power E3. The electric power E3 includes electric power E31 for causing the Com driver 73 to operate and electric power E32 for causing the holding circuits 58 to operate. More specifically, the Com driver 73 operates by receiving supply of the electric power E31 from the third power supply 44*c*, thereby supplying the common potential $V_{com}$ (common signal) to the common electrodes 23. The Com driver 73 operates, thereby supplying the display signal or the inversion display signal to the reflective electrodes 15 via the FRP wiring or the xFRP wiring. The third power supply 44*c* supplies the electric power E32 to both inverters in each of the memory cells 57 of the respective pixels Pix by using the power supply line VDD for a high potential and the power supply line VSS for a low potential. As a result, the memory cells 57 always hold a signal. A fourth power supply 44*d* supplies electric power E4 required for causing the gate driver 72 to operate and maintaining functions of the gate driver 72. The gate driver 72 receives, from the fourth power supply 44*d*, individually inputs of both of the electric potential (VGH) of the scanning lines GCL to which the scanning signal Vscan is applied and the electric potential (VGL) to which the scanning signal Vscan is not applied.

If the determination signal JU is not output, the system controller 43 causes the first power supply 44*a* and the second power supply 44*b* to operate. This causes the timing controller 45, the source driver 71, and the gate driver 72 to operate. Consequently, the source driver 71 outputs the pixel signals SIG, and the gate driver 72 performs scanning under the timing control performed by the timing controller 45. In other words, the pixel signals SIG are output to the respective pixels Pix every time the frames are switched. As a result, an image displayed in the display region DA is updated corresponding to switching of the frames, thereby displaying a moving image. As described above, the system controller 43 brings the state of the driver D (the timing controller 45 and the source driver 71) based on moving image signals into the first state (a state for driving a plurality of pixels Pix based on the moving image signals and supplying the pixel signals SIG to the holding circuits 58 of the respective pixels Pix). When the driver D operates in the first state, refresh in the digital display mode is performed. FIG. 1 illustrates the display device 1 when the driver D (the timing controller 45 and the source driver 71) is in the first state.

Figure 8:
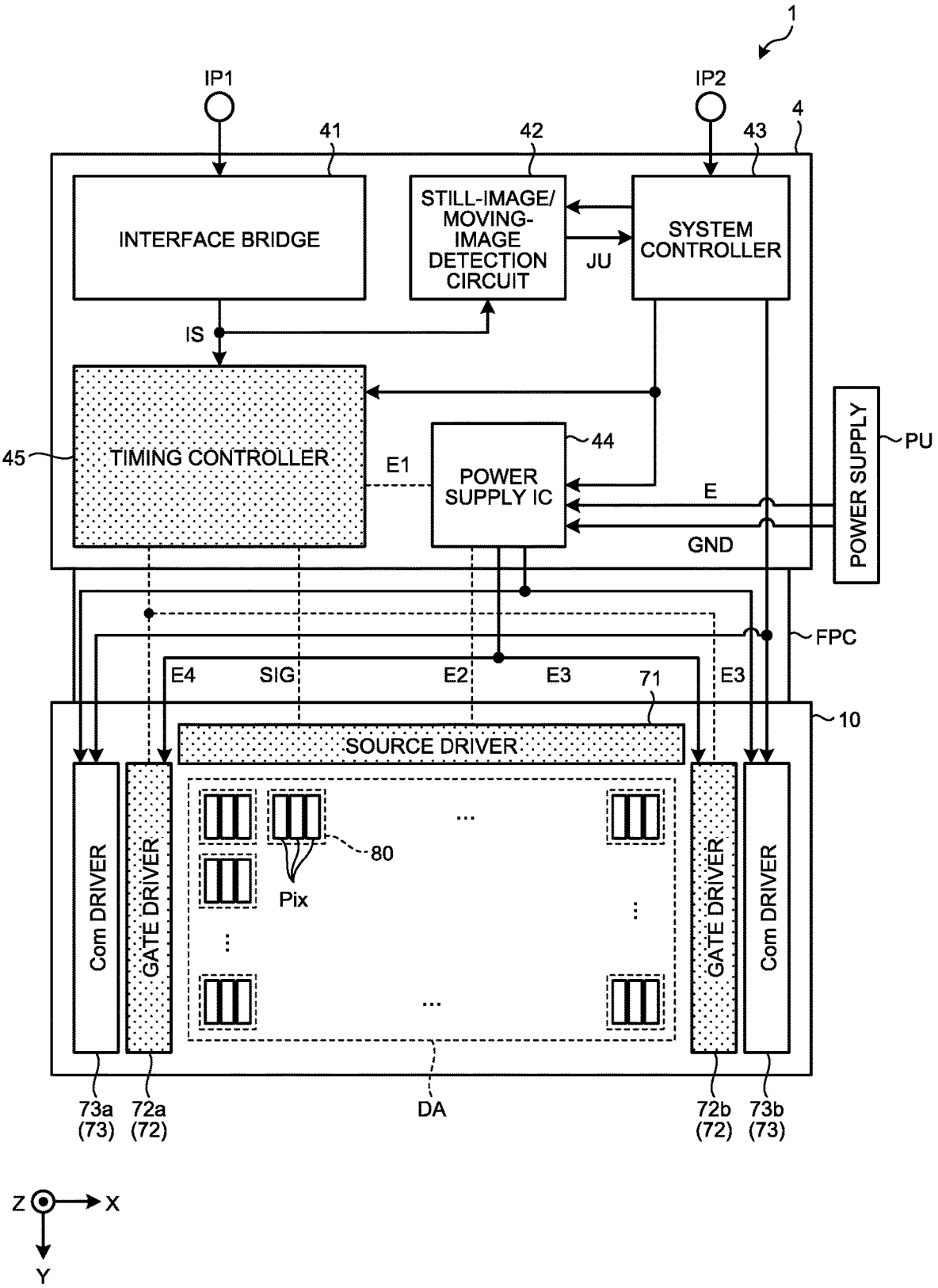
FIG. 8 is a block diagram of the display device when a driver is in a second state.

FIG. 8 is a block diagram of the display device 1 when the driver D is in the second state. If the determination signal JU is output, the system controller 43 causes the first power supply 44*a* and the second power supply 44*b* to stop supplying electric power. This causes the timing controller 45 and the source driver 71 to stop operating. In other words, the system controller 43 brings the state of the driver D (the timing controller 45 and the source driver 71) based on still image signals into the second state (a state in which the operation stops). As described above, the system controller 43 controls operations of the driver D. With the stop of the source driver 71, the system controller 43 according to the present embodiment causes the gate driver 72 to stop scanning based on the timing for transmitting the pixel signals SIG from the source driver. In other words, the timing controller 45 also stops outputting signals for controlling the timing for scanning performed by the gate driver 72. As a result, refresh in the digital display mode stops, thereby shifting the display mode to the memory display mode. In FIG. 8, a dot pattern is applied to each of the timing controller 45, the source driver 71, and the gate driver 72 that stop operations for refresh. In FIG. 8, dashed lines indicate output paths of signals, which are not output if the timing controller 45, the source driver 71, and the gate driver 72 stop operations for refresh.

If the source driver 71 stops operating, the signal lines SGL are brought into a floating state. The signal lines SGL in the floating state is in high impedance with respect to the ground GND. If the gate driver 72 stops operating, the electric potential of the scanning lines GCL becomes an electric potential (VGL) with no scanning signal Vscan applied. In other words, the electric potential VGL keeps the switching elements 51 in an open state (gate-off state). This electric potential (VGL) according to the present embodiment is the ground GND. The electric potential of the scanning lines GCL is maintained by the electric power E4 from the fourth power supply 44*d*. In other words, the stopped state of the gate driver 72 is a state where the gate driver 72 stops scanning, that is, a state where the electric potential VGL is supplied to the scanning lines GCL. As described above, in the second state, switching the frames with a predetermined period stops, whereby the pixel signals SIG held by the memory cells 57 in the respective pixels Pix remain the latest pixel signals SIG output before the source driver 71 stops. As a result, the image produced in the display region DA remains a still image corresponding to the latest pixel signals SIG output before the source driver 71 stops.

The third power supply 44*c* and the fourth power supply 44*d* operate to supply electric power regardless of whether the determination signal JU is output. In other words, even if the refresh performed by the timing controller 45, the source driver 71, and the gate driver 72 stops, the display region DA continues to display and output an image corresponding to the state of the pixels Pix held by the memory cells 57, and the electric potential of the scanning lines GCL is maintained. During the operations of the display device 1, the power supply IC 44 supplies electric power, which is not illustrated, to the components, such as the interface bridge 41, the still-image/moving-image detection circuit 42, and an inversion switch, that operate regardless of whether the image signals IS are still image signals or moving-image signals. In other words, the interface bridge 41 outputs the image signals IS, the still-image/moving-image detection circuit 42 determines an image, and the inversion switch drives, for example, regardless of the determination result of the image.

Figure 9:
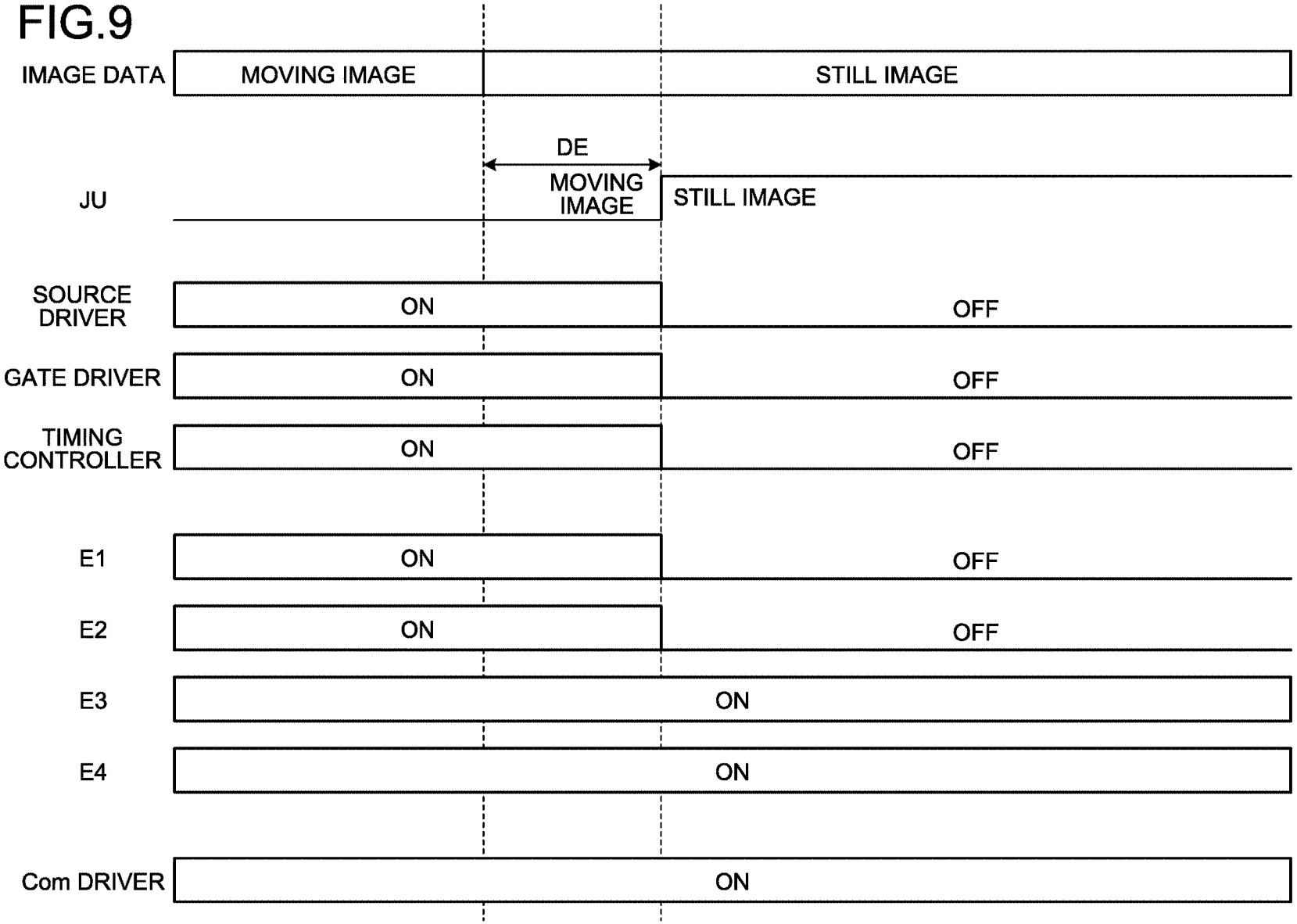
FIG. 9 is a timing chart illustrating the states of components before and after image data switches from a moving image to a still image.

FIG. 9 is a timing chart illustrating the states of components before and after image data switches from a moving image to a still image.

As illustrated in FIG. 9, if the image data included in the image signals IS is data of a moving image, the system controller 43 does not output the determination signal JU. As a result, the determination signal JU is in a low state. Because the determination signal JU is in a low state, the first power supply 44*a* supplies the electric power E1, and the second power supply 44*b* supplies the electric power E2. With the electric power E1 output from the first power supply 44*a*, the timing controller 45 is in an operating state. With the electric power E2 output from the second power supply 44*b*, the source driver 71 and the gate driver 72 are in an operating state (ON) in which they perform refresh. As a result, the pixel signals SIG in the pixels Pix are updated when the frame images are switched. Consequently, the images produced in the display region DA are switched depending on the data of a moving image.

If the image data included in the image signals IS is switched from data of a moving image to data of a still image, the system controller 43 outputs the determination signal JU after a delay time DE has elapsed. The delay time DE is a time required to switch all the pieces of data stored in the n registers to the pieces of data corresponding to a still image. As a result, the determination signal JU is in a high state. Because the determination signal JU is in a high state, the first power supply 44*a* stops supplying the electric power E1, and the second power supply 44*b* stops supplying the electric power E2. The timing controller 45, the source driver 71, and the gate driver 72 are in a non-operating state (OFF) in which they do not perform refresh. This stops the updates of the pixel signals SIG in the pixels Pix, which are performed in accordance with the switching of the frame images, and remains the latest pixel signals SIG held by the memory cells 57. Consequently, the image produced in the display region DA is a still image corresponding to the latest pixel signals SIG.

The length of the delay time DE depends on the number (n) of registers included in the storage 42*b* and the degree (p) of continuity of frames to be encoded.

Figure 10:
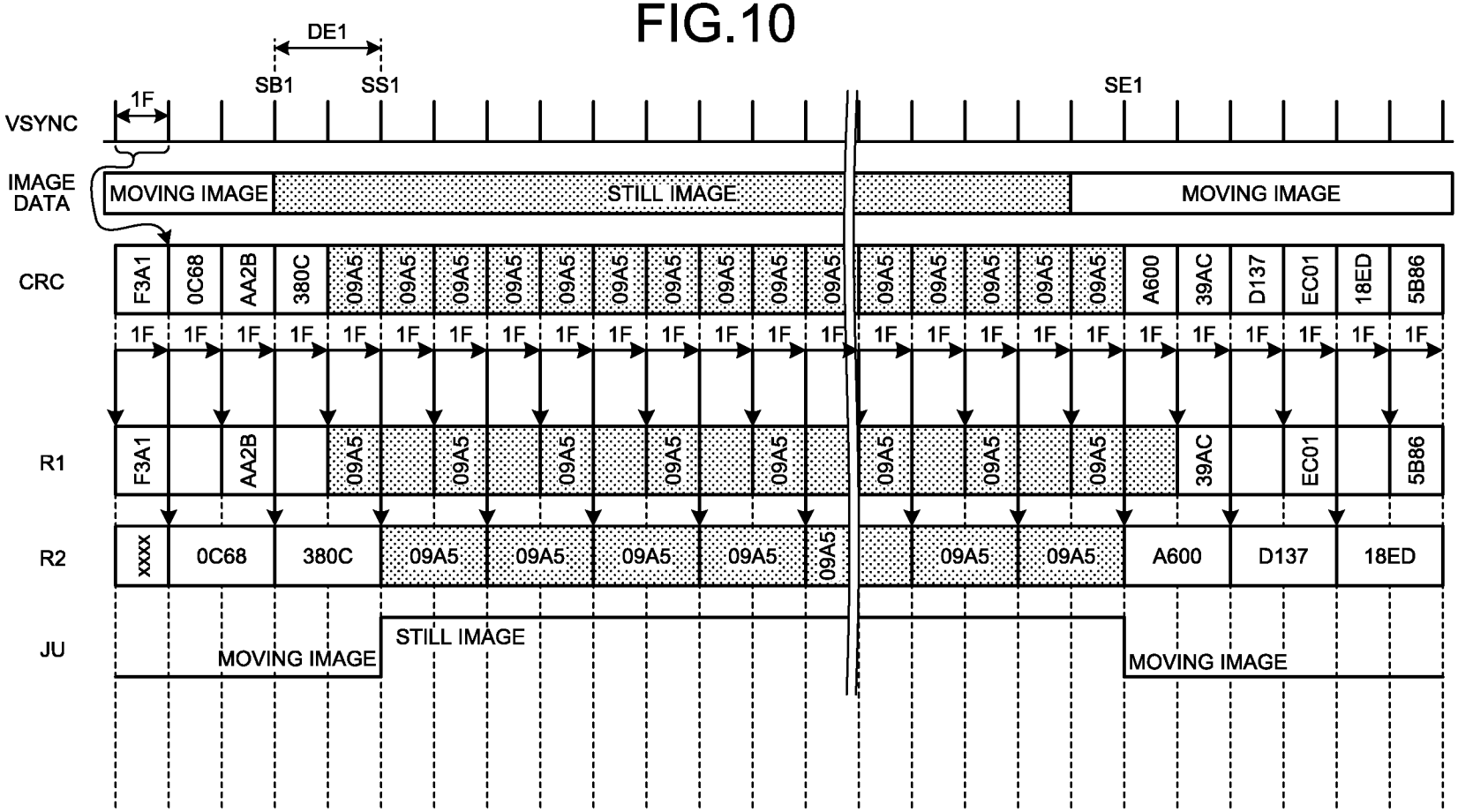
FIG. 10 is a timing chart illustrating a relation between the data stored in registers and a determination signal in a case where encoding is performed on every one frame using two registers.
Figure 11:
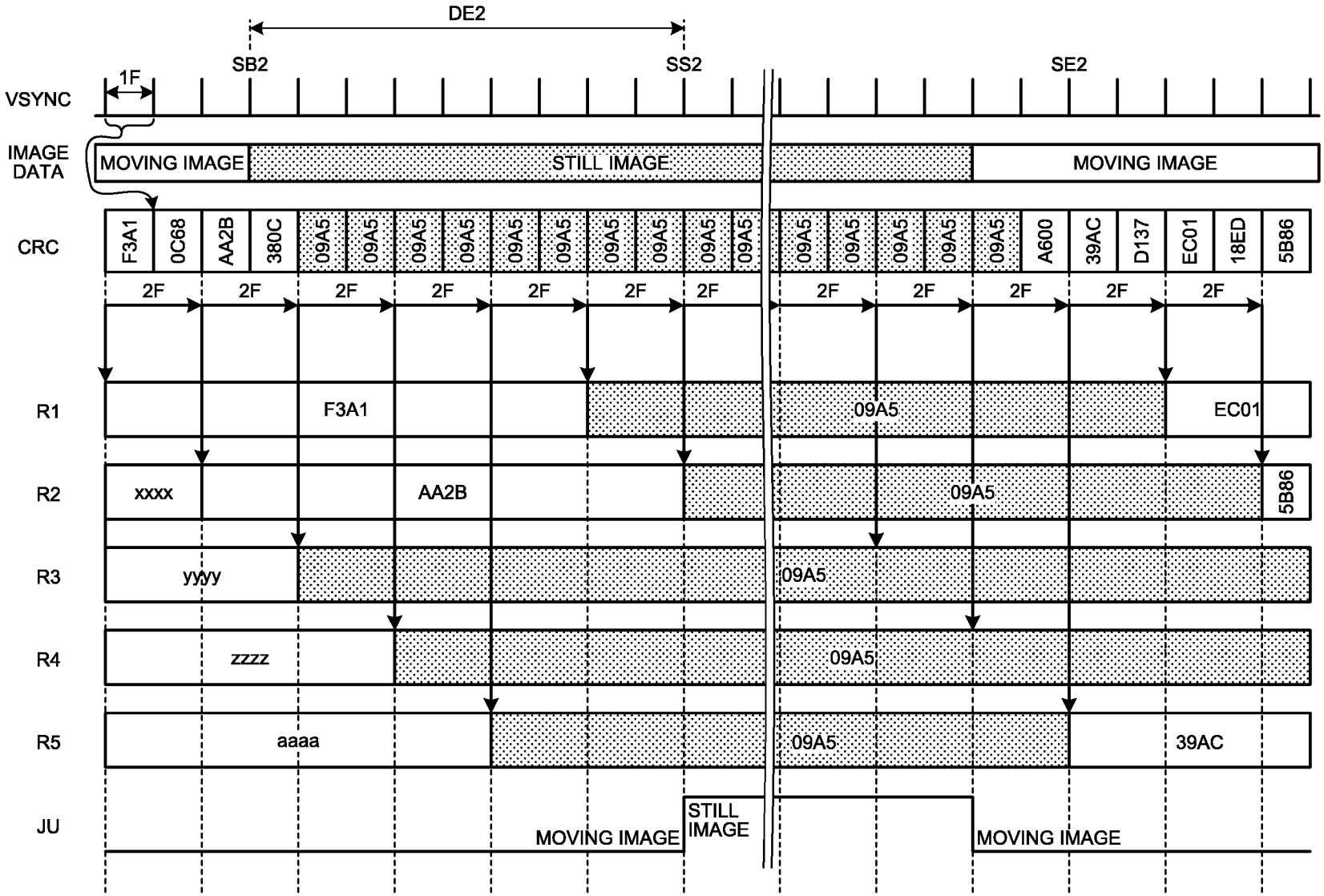
FIG. 11 is a timing chart illustrating a relation between the data stored in the registers and the determination signal in a case where encoding is performed on every two frames using five registers.

FIG. 10 is a timing chart illustrating a relation between the data stored in the registers and the determination signal JU in a case where encoding is performed on every one frame using two registers. In other words, n=2 and p=1 are satisfied in FIG. 10. While FIG. 10 and FIG. 11, which will be described later, illustrate the CRC encoded data obtained when CRC-16 is employed for encoding, this is given by way of example only, and the present embodiment is not limited thereto. FIGS. 10 and 11 illustrate one frame time 1F corresponding to the time between consecutive vertical synchronization signals VSYNC. In FIGS. 10 and 11, the CRC encoded data of an image signal IS is stored in the register by a delay of one frame time 1F with respect to the input timing of the vertical synchronization signal VSYNC of the image signal IS to be encoded.

In the example illustrated in FIG. 10, n=2 is satisfied, and thus the storage 42*b* includes the first register R1 and the second register R2. In addition, p=1 is satisfied, and thus the image signals IS of all the frames are encoded for each frame. Consequently, two frames corresponding to two pieces of CRC encoded data stored in the first register R1 and the second register R2 are two consecutive frames. The CRC encoded data stored in the first register R1 is updated with the CRC encoded data corresponding to the frame next to the frame corresponding to the CRC encoded data stored in the second register R2.

The image data before timing SB1 represents a moving image. Consequently, the CRC encoded data varies in every frame. In this period of time, the system controller 43 does not output the determination signal JU (the determination signal JU is in a low state).

The image data after the timing SB1 represents a still image. After one frame time 1F has elapsed since timing SB1, the pieces of CRC encoded data are identical (09A5). In FIG. 10, after one frame time 1F has elapsed since timing SB1, the CRC encoded data of "09A5" is stored in the first register R1. After a time of two frames (1F+1F=2F) has elapsed since timing SB1, the CRC encoded data of "09A5" is stored in the second register R2. Consequently, the pieces of CRC encoded data being stored in the first register R1 and the second register R2 are identical at timing SS1 when a time of two frames (2F) has elapsed since timing SB1. At this timing, the system controller 43 starts outputting the determination signal JU (the determination signal JU is in a high state). In other words, when n=2 and p=1 are satisfied, the delay time DE (refer to FIG. 9) is a first delay time DE1 (=2F) as illustrated in FIG. 10.

After timing SS1, the image data switches to a moving image again. As a result, the CRC encoded data being stored in the first register R1 is different from the CRC encoded data stored in the second register R2 at timing SE1. Consequently, the system controller 43 stops outputting the determination signal JU (the determination signal JU is in a low state).

FIG. 11 is a timing chart illustrating a relation between the data stored in the registers and the determination signal JU in a case where encoding is performed on every two frames using five registers. In other words, n=5 and p=2 are satisfied in FIG. 11.

In the example illustrated in FIG. 11, n=5 is satisfied, and thus the storage 42*b* includes the first register R1, the second register R2, . . . , and the fifth register R5. In addition, p=2 is satisfied, and thus the image signals IS are encoded for every other frame. Consequently, one unencoded frame is interposed between two frames corresponding to two pieces of CRC encoded data stored in the m-th register Rm and the (m+1)-th register R(m+1). The CRC encoded data stored in the first register R1 is updated with the CRC encoded data corresponding to the frame two frames after the frame corresponding to the CRC encoded data stored in the fifth register R5.

The image data before timing SB2 represents a moving image. Consequently, the CRC encoded data varies in every other frame. In this period of time, the system controller 43 does not output the determination signal JU (the determination signal JU is in a low state).

The image data after timing SB2 represents a still image. At a timing after timing SB2 and after the first timing for encoding, the pieces of CRC encoded data are identical (09A5). In FIG. 11, after one frame time 1F has elapsed since timing SB2, the CRC encoded data of "09A5" is stored in the third register R3. After a time of three frames (1F+1F+1F=3F) has elapsed since timing SB2, the CRC encoded data of "09A5" is stored in the fourth register R4. Subsequently, at timings when times of five, seven, and nine frames have elapsed since timing SB2, the CRC encoded data of "09A5" is stored in the fifth register R5, the first register R1, and the second register R2, respectively. Consequently, all the five pieces of CRC encoded data being stored in the first register R1 to the fifth register R5 are identical at timing SS2 when a time of nine frames (1F×9=9F) has elapsed since timing SB2. Consequently, the system controller 43 outputs the determination signal JU (the determination signal JU is in a high state). In other words, when n=5 and p=2 are satisfied, the delay time DE (refer to FIG. 9) is a second delay time DE2 (=9F) as illustrated in FIG. 11.

The timing when the image data switches from a moving image to a still image may possibly be earlier than timing SB2 illustrated in FIG. 11 by one frame period (1F). In this case, the CRC encoded data of "09A5" is stored in the third register R3 when a time of two frames (1F+1F=2F) has elapsed since the timing when the image data switches from the moving image to the still image. In this case, the delay time DE (refer to FIG. 9) is longer than that in the example illustrated in FIG. 10 by one frame time 1F (+1F). Consequently, when n=5 and p=2 are satisfied, the delay time DE (refer to FIG. 9) is a time of nine to ten frames.

After timing SS2, the image data switches to a moving image again. As a result, the CRC encoded data being stored in the fifth register R5 is different from the pieces of CRC encoded data being stored in the other registers at timing SE2. Consequently, the system controller 43 stops outputting the determination signal JU (the determination signal JU is in a low state).

As described with reference to FIGS. 10 and 11, the delay time DE is a time of frames the number of which corresponds to a natural number of n×p or smaller. The time until the determination signal JU shifts from the low state to the high state when the image data switches from a moving image to a still image is shorter than the delay time DE (a time of frames the number of which corresponds to a natural number of p or smaller).

While the number (n) of registers and the degree (p) of continuity of frames to be encoded have been described with reference to FIGS. 10 and 11, n and p may be any desired numbers.

Figure 12:
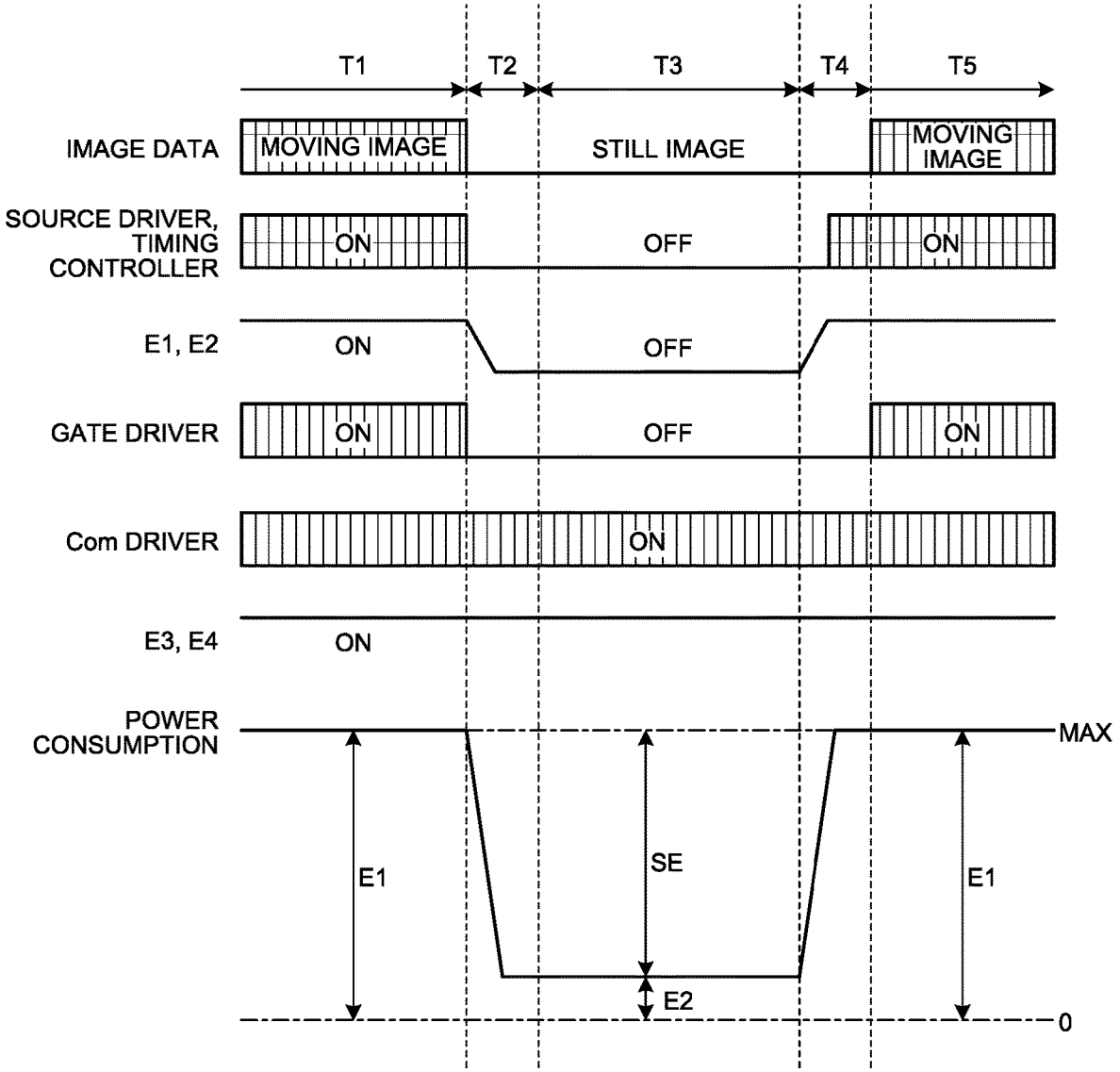
FIG. 12 is a schematic timing chart illustrating operations of the components and the state of electric power corresponding to switching of the image data.

FIG. 12 is a schematic timing chart illustrating operations of the components and the state of electric power corresponding to switching of the image data. As illustrated in FIG. 12, in time period T1 and time period T5 when the image data is a moving image, the first power supply 44*a* supplies the electric power E1, and the second power supply 44*b* supplies the electric power E2. As a result, the timing controller 45, the source driver 71, the gate driver 72, and the Com driver 73 operate. In time period T2, it is determined that the image data shifts from the moving image to a still image based on the data stored in the registers included in the storage 42*b*. After time period T2 has elapsed, the first power supply 44*a* stops supplying the electric power E1, and the second power supply 44*b* stops supplying the electric power E2. As a result, the timing controller 45, the source driver 71, and the gate driver 72 stop operations for refresh. Consequently, in time period T3 in which the image data represents a still image, only the third power supply 44*c* and the fourth power supply 44*d* supply electric power. Specifically, the third power supply 44*c* supplies the electric power E3 for causing the Com driver 73 and the holding circuits 58 of the respective pixels Pix to operate, and the fourth power supply 44*d* supplies the electric power E4 for maintaining the electric potential of the scanning lines GCL in the memory display mode, that is, the electric potential of VGL (gate-off potential). In other words, in time period T3, the components that require power supply to maintain image display are limited to the minimum components required for the memory display mode. More specifically, the display device 1 can reduce power consumption by stopping the operations of the driver D in displaying a still image. Also in time period T2 and time period T4 in which it is determined that the image data shifts from the still image to a moving image based on the data stored in the registers included in the storage 42*b*, the display device 1 can reduce power consumption, compared with power consumption in time period T1 and time period T5.

FIG. 12 illustrates power consumption E1 of the display device 1 performing operations including operations for refresh, power consumption E2 of the display device 1 that stops operations for refresh, and difference SE between power consumption E1 and power consumption E2. Power consumption E2 according to the embodiment can be 40 percent of power consumption E1.

As described above, the display device 1 of the embodiment includes the holding circuits 58 and the driver D (the timing controller 45 and the source driver 71). The holding circuits 58 each keep the state of the corresponding pixel Pix in the latest drive state. The driver D can stop operating in accordance with a still image. With this configuration, the embodiment can stop the driver D in displaying a still image, thereby reducing power consumption. In addition, the display device 1 of the embodiment encodes the image signals IS of a plurality of frames on a frame basis and stores pieces of data resulting from encoding the image signals IS of the frames. The display device 1 of the embodiment compares the pieces of data resulting from encoding on a frame basis and determines whether the image signals IS of the frames are moving image signals or still image signals. This configuration can cause the accuracy in determining whether the image signals IS of a plurality of frames are moving image signals or still image signals to be equivalent to the accuracy in distinguishing between the pieces of data obtained by encoding different pieces of data. Consequently, the display device 1 of the embodiment can distinguish a moving image from a still image with higher accuracy by a method that can convert different pieces of data into different codes with higher accuracy.

By employing the CRC technique, the display device 1 of the embodiment can distinguish a moving image from a still image with higher accuracy.

With the timing controller 45 and the source driver 71 included in the driver D, the display device 1 of the embodiment can further reduce power consumption. The timing controller 45, which generates the pixel signals SIG based on the image signals IS, consumes a large amount of power. By stopping the operations of the driver D including the timing controller 45 in displaying a still image, the display device 1 of the embodiment can further reduce power consumption.

With the memory cells 57 that hold the latest input pixel signals SIG, the display device 1 of the embodiment can stop the driver D in displaying a still image, thereby further reducing power consumption.

The display panel 10 and the driver D (the timing controller 45 and the source driver 71) are combined in the embodiment. The display panel 10 is provided with the pixels Pix each including the reflective electrode 15. The driver D can stop operating corresponding to a still image. This configuration can further reduce power consumption of a reflective liquid crystal display device that does not necessarily require any light source and can achieve higher power-saving performance.

The timing controller 45 may perform additional image processing in the processing of generating the pixel signals SIG based on the image signals IS. The additional image processing includes error diffusion. Error diffusion is processing of reproducing the gradation of a certain pixel Pix in the image signals IS using a combination of the certain pixel Pix and pixels Pix (e.g., adjacent pixels Pix) around the certain pixel Pix. If the unit pixel 80 includes the pixel Pix of W (white), the additional image processing also includes processing of allocating the luminance components of the unit pixel 80 to the pixel Pix of W (white).

While the determination signal JU according to the embodiment is in a high state when the image data included in the image signals IS represents a still image, the embodiment is not limited thereto. The still-image/moving-image detection circuit 42 simply needs to output a signal indicating the result of determining whether the image data is a moving image or a still image. The high state and the low state of the determination signal JU may be reversed. In this case, the determination result by the component (system controller 43) that determines whether the image data is a moving image or a still image based on the determination signal JU is also reversed.

While the unit pixel 80 according to the embodiment includes a plurality of pixels Pix, it may be one pixel Pix. While both of the timing controller 45 and the source driver 71 according to the embodiment stop operating in the second state, one of them may stop operating. By causing at least part of the components included in the driver D (the timing controller 45 and the source driver 71) to stop operating, the display device of the embodiment can reduce power consumption.

Other operational advantages accruing from the aspects described in the embodiments that are obvious from the description herein or that are appropriately conceivable by those skilled in the art will naturally be understood as accruing from the present invention.

What is claimed is:

1. A display device comprising:

a display unit including a plurality of pixels, each pixel including a holding circuit configured to hold an electric potential that is input as a pixel signal;

a driver configured to drive the pixels based on image signals and supply the pixel signals to the holding circuits of the respective pixels;

an encoding circuit configured to encode the image signals on a frame basis by an error-detection encoding technique;

a storage configured to store therein a plurality of pieces of error-detection encoded data resulting from encoding on a frame basis;

a determination circuit configured to compare the pieces of error-detection encoded data and determine whether the image signals for a plurality of consecutive frames are moving image signals or still image signals; and a controller configured to control the driver based on the image signals and the result of the determination circuit, wherein the controller brings the driver into a first state for driving the pixels based on the image signals when the result of the determination circuit indicates the moving image signals, wherein the controller brings the driver into a second state for causing at least part of the driver to stop operating when the result of the determination circuit indicates the still image signals, and wherein the driver comprises:

a timing controller configured to generate the pixel signals for individually driving the pixels based on the image signals; and a signal output circuit coupled to the pixels via a plurality of signal lines and configured to supply the pixel signals to the pixels, and wherein the controller controls the driver to cause at least one of the timing controller or the signal output circuit to stop operating in the second state.

2. The display device according to claim 1, wherein the code generated by the encoding is a cyclic redundancy check code.

3. The display device according to claim 1, further comprising:

a power supply circuit configured to be controlled by the controller and supply electric power to the driver, wherein, when the result of the determination circuit indicates the still image signals, the controller brings the driver into the second state by causing the power supply circuit to stop power supply to the timing controller.

4. The display device according to claim 1, further comprising:

a power supply circuit controlled by the controller and configured to supply electric power to the driver, wherein, when the result of the determination circuit indicates the still image signals, the controller brings the driver into the second state by causing the power supply circuit to stop power supply to the signal output circuit.

5. The display device according to claim 1, wherein each of the pixels includes a reflective electrode configured to reflect light entering from outside of the display unit.

* * * * *